US008220781B2

(12) United States Patent
Gray

(10) Patent No.: US 8,220,781 B2
(45) Date of Patent: Jul. 17, 2012

(54) FENCE POST CONNECTION

(75) Inventor: Daniel M. Gray, McKinney, TX (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 72 days.

(21) Appl. No.: 12/465,451

(22) Filed: May 13, 2009

(65) Prior Publication Data

US 2010/0288992 A1 Nov. 18, 2010

(51) Int. Cl.
*E04H 17/00* (2006.01)

(52) U.S. Cl. ..... 256/65.13; 256/65.02

(58) Field of Classification Search ..... 256/65.02, 256/65.03, 65.13, 68; 403/188, 199, 386, 403/398, 399; 248/74.1, 74.2
See application file for complete search history.

(56) References Cited

U.S. PATENT DOCUMENTS

| | | | | |
|---|---|---|---|---|
| 558,391 | A * | 4/1896 | Israel | 248/74.4 |
| 677,765 | A | 7/1901 | Hoerr | |
| 930,181 | A | 8/1909 | Huffman | |
| 1,069,937 | A | 8/1913 | Goehst et al. | |
| 1,341,113 | A * | 5/1920 | Dottl et al. | 248/74.1 |
| 1,527,346 | A * | 2/1925 | Brady | 248/74.1 |
| 1,943,766 | A | 1/1934 | MacDonald | |
| 2,550,001 | A * | 4/1951 | Button | 248/49 |
| 2,824,270 | A | 2/1958 | Anderson | |
| 2,835,002 | A | 5/1958 | Majewski | |
| 3,227,406 | A | 1/1966 | Shelton et al. | |
| 3,310,264 | A | 3/1967 | Appleton | |
| 3,430,674 | A | 3/1969 | Forbush | |
| 3,524,627 | A * | 8/1970 | Boyanton et al. | 256/65.06 |
| 3,583,663 | A | 6/1971 | Snow | |
| 3,614,871 | A * | 10/1971 | Nordell | 405/221 |
| 4,007,993 | A | 2/1977 | Schwartz | |
| 4,214,841 | A | 7/1980 | Hayashi | |
| 4,219,285 | A | 8/1980 | Hayashi | |
| 4,325,175 | A | 4/1982 | Milner | |
| 4,471,947 | A * | 9/1984 | Osborne | 256/24 |
| 4,526,348 | A | 7/1985 | Cammack | |
| 4,799,641 | A * | 1/1989 | Koreski | 248/68.1 |
| 4,892,276 | A * | 1/1990 | Alessio | 248/74.1 |
| 4,899,991 | A * | 2/1990 | Brunkan | 256/69 |
| 4,915,305 | A | 4/1990 | O'Brien et al. | |

(Continued)

FOREIGN PATENT DOCUMENTS

AU 0283666 12/1966

(Continued)

OTHER PUBLICATIONS

Jamieson Mfg. and Cox Fence Fitting, two photographs showing state of the art, Exhibit Ref. AR, undated, 1 page, submitted on Feb. 20, 1992 in IDS for U.S. Appl. No. 07/839,127.

(Continued)

*Primary Examiner* — Joshua Kennedy
(74) *Attorney, Agent, or Firm* — James R. Cypher; Charles R. Cypher

(57) ABSTRACT

A fence-frame-to-post connector comprises two separate members joined by one or more fasteners separate from the members. One member is attached to the fence frame with additional fasteners separate from those used to join the two members and also separate from the connector. One of the fasteners that joins the two members of the connector can be a hinge that is preferably made by a key tab and key slot combination in which the key pivots in the keyhole.

23 Claims, 11 Drawing Sheets

U.S. PATENT DOCUMENTS

| | | | | |
|---|---|---|---|---|
| 5,048,776 | A * | 9/1991 | Weiss | 248/74.1 |
| 5,281,042 | A * | 1/1994 | Belrose | 403/234 |
| 5,295,754 | A | 3/1994 | Kato | |
| 5,297,890 | A * | 3/1994 | Commins | 403/398 |
| 6,241,200 | B1 * | 6/2001 | Camporeale et al. | 248/68.1 |
| 6,257,530 | B1 | 7/2001 | Tsai | |
| 6,340,142 | B1 | 1/2002 | Li | |
| 6,386,519 | B1 * | 5/2002 | Priefert | 256/68 |
| 6,607,172 | B1 | 8/2003 | Green et al. | |
| 6,634,606 | B2 | 10/2003 | Heath | |
| 6,658,806 | B1 | 12/2003 | Leek | |
| 7,114,282 | B2 | 10/2006 | Nakagawa | |
| 7,153,064 | B2 * | 12/2006 | Zeilinger et al. | 405/221 |
| D538,148 | S | 3/2007 | Dinh et al. | |
| 7,325,776 | B2 * | 2/2008 | Shibuya | 248/62 |
| 7,384,018 | B2 * | 6/2008 | Moretto | 248/74.1 |
| 7,472,870 | B2 * | 1/2009 | Zagorski et al. | 248/65 |
| 7,611,101 | B2 * | 11/2009 | van Walraven | 248/74.4 |
| 2002/0171013 | A1 * | 11/2002 | Nicolia et al. | 248/74.1 |
| 2004/0026576 | A1 * | 2/2004 | Shibuya | 248/62 |
| 2005/0116123 | A1 * | 6/2005 | Bailey et al. | 248/74.1 |
| 2010/0219301 | A1 * | 9/2010 | Sampson | 248/74.1 |

FOREIGN PATENT DOCUMENTS

| | | |
|---|---|---|
| GB | 0300769 | 11/1928 |
| GB | 0414755 | 8/1934 |

OTHER PUBLICATIONS

Master Halco, one photograph showing state of the art, Exhibit Ref. AS, undated, 1 page, submitted on Feb. 20, 1992 in IDS for U.S. Appl. No. 07/839,127.

Darnell Mfg., two photographs showing state of the art, Exhibit Ref. AT, undated, 1 page, submitted on Feb. 20, 1992 in IDS for U.S. Appl. No. 07/839,127.

Darnell Mfg., two photographs showing state of the art, Exhibit Ref. AU, undated, 1 page, submitted on Feb. 20, 1992 in IDS for U.S. Appl. No. 07/839,127.

OZ-Post, How Do I Install IS-FBS?, undated, 4 pages, received by James R. Cypher on Sep. 19, 2008.

* cited by examiner

FENCE POST CONNECTION

BACKGROUND OF THE INVENTION

This invention relates to a connector for making a fence-frame-to-post connection. A primary use of the present invention is in the connection of wood fence members to a metal post member. Prior art patents do not disclose an equally simple and easy to install fence-frame-to-post connection. Several unpatented fence-frame-to-post connections are in use, but none are as simple to manufacture and easy to install as the present invention. The present invention improves on the prior art by providing a connector that aligns its halves along one axis, easing installation. A preferred embodiment of the present invention improves on the prior art by providing a connector that has a hinged connection between its halves, further easing installation.

SUMMARY OF THE INVENTION

It is an object of the present invention to provide a fence-frame-to-post connector having two separate members joined by one or more fasteners. The fasteners that join the members are separate from the members and separate from the fasteners that attach the connector to the fence frame. This allows the connection to the post to be made separately from, and prior to, the connection to the fence frame. One member is attached to the fence frame with additional fasteners separate from those used to join the two members and also separate from the connector. One of the fasteners that joins the two members of the connector can be a hinge that is preferably made by a key tab and key slot combination in which the key pivots in the keyhole.

It is a further object of the present invention to provide a fence-frame-to-post connector with tabs that shield the ends of the fasteners used to join the connector members and that also align the connector members horizontally, easing installation. Still a further object of the present invention is to provide a fence-frame-to-post connector that is formed to mate with the outer surface of a cylindrical metal post, thereby easing installation. Still a further object of the present invention is to provide a fence-frame-to-post connector that has two members connected by a hinge, allowing the members to be pivoted together around the fence post. Still a further object of the present invention is to provide a fence-frame-to-post connector with a key tab and key slot combination that allows the hinge to be formed by the installer, which in turn facilitates one-handed installation on the fence post. Still a further object of the invention is to provide a fence-frame-to-post connector integral fastener retainers, either in the form of simple fastener openings or in the form of attached nuts. Still a further object of the invention is to provide a fence-frame-to-post connector that has horizontally self-aligning members by virtue of matched bend lines in the two members. Still a further object of the invention is to provide a fence-frame-to-post connector with enhanced support of the fence frame member by virtue of tabs that extend beneath the fence frame member. Still a further object of the invention is to provide a fence-frame-to-post connector that connects a metal post and a wood fence frame member. Still a further object of the present invention is to provide a fence-frame-to-post connector that eases installation on the post by snapping onto the post. These and other object of the invention are explained and illustrated below.

DESCRIPTION OF THE PREFERRED EMBODIMENT

Figure 1:
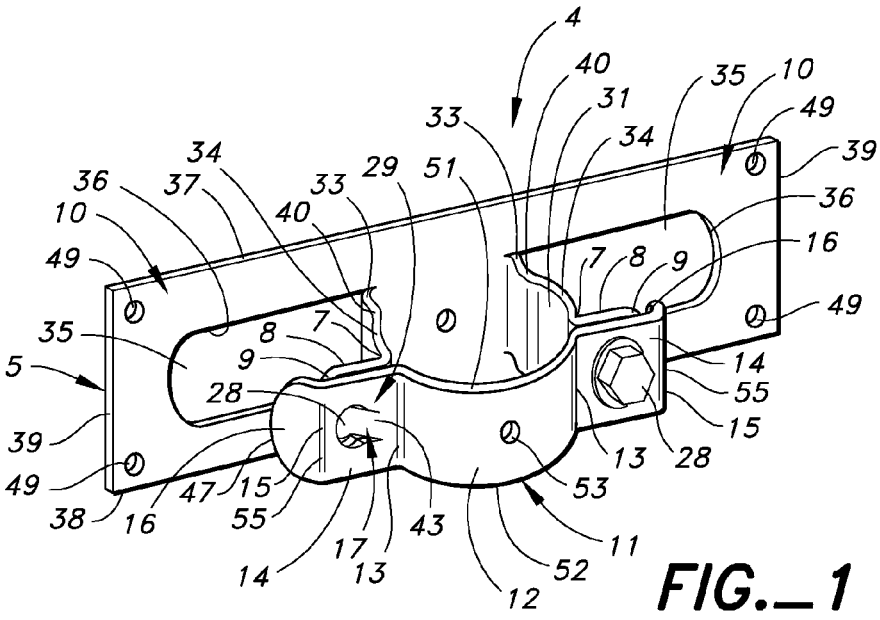
FIG. 1 is a perspective view of a key tab and key slot hinged connector of the present invention.
Figure 2:
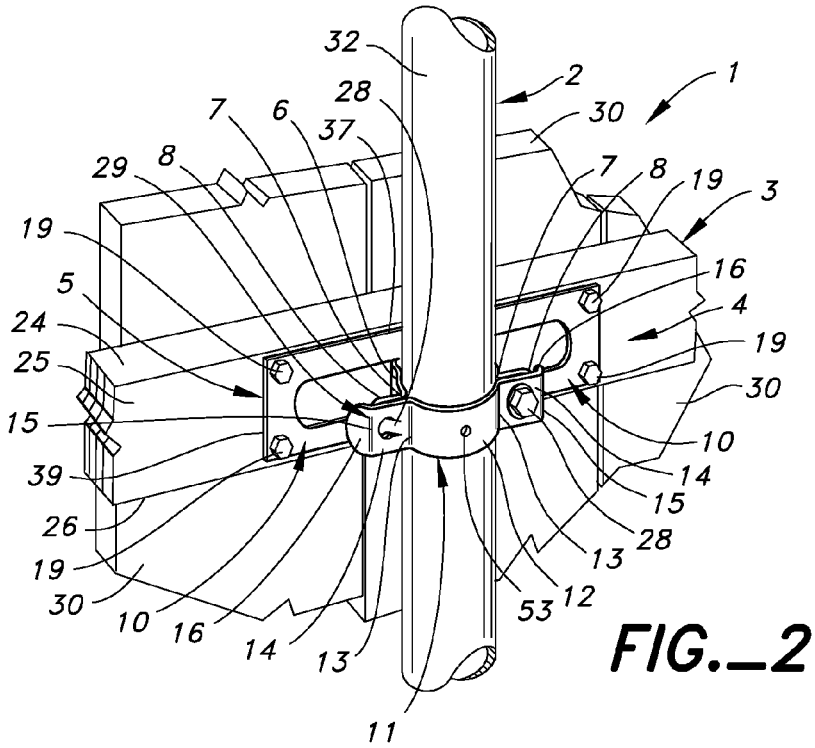
FIG. 2 is a perspective view of a key tab and key slot hinged connection of the present invention.
Figure 3:
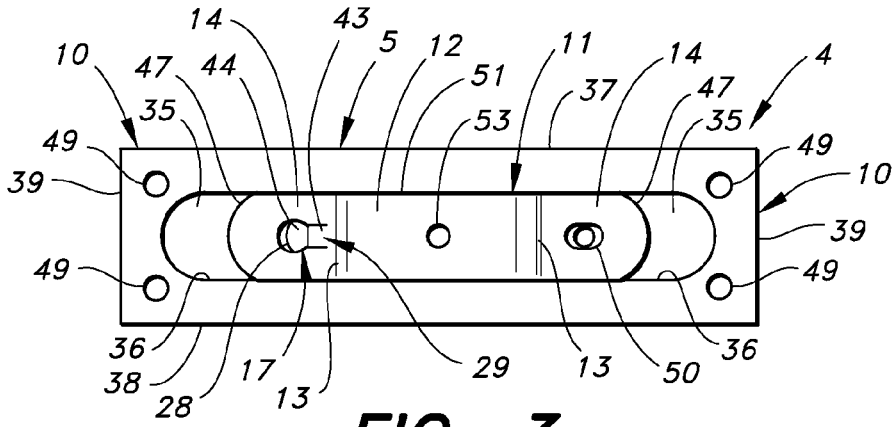
FIG. 3 is a front elevation cross-sectional view of a key tab and key slot hinged connector of the present invention.
Figure 4:
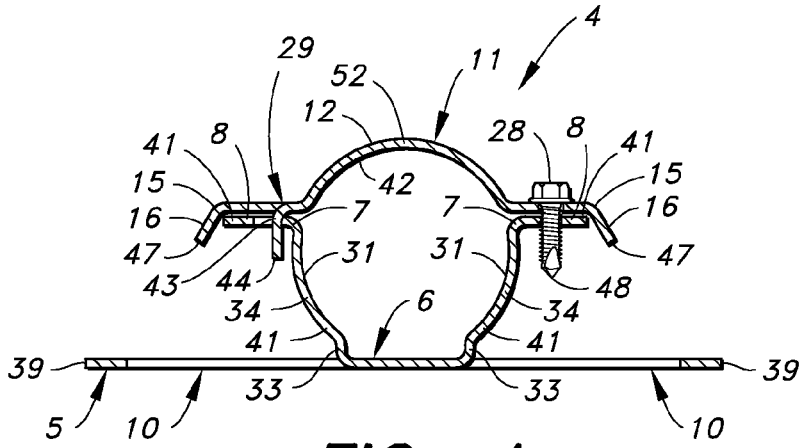
FIG. 4 is a bottom plan, partially cross-sectional view of a key tab and key slot hinged connector of the present invention.
Figure 5:
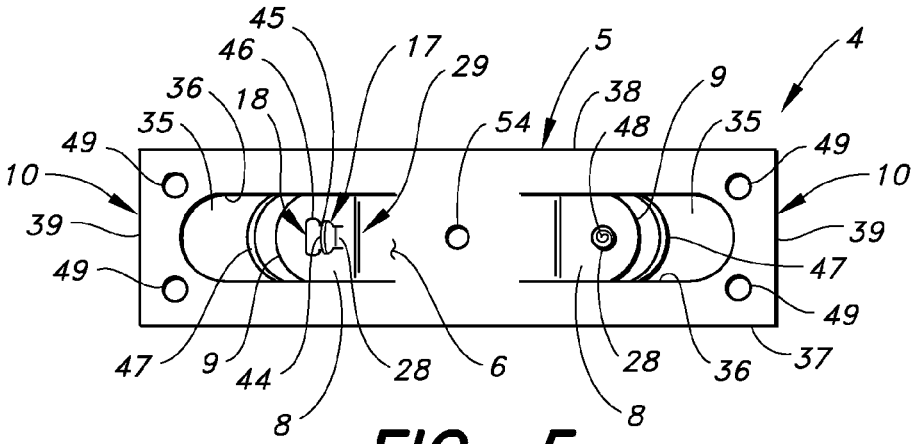
FIG. 5 is a rear elevation view of a key tab and key slot hinged connector of the present invention.
Figure 6:
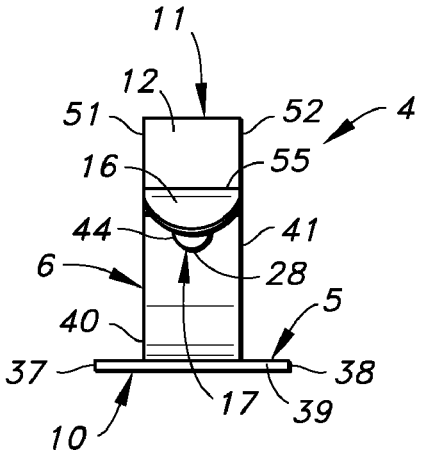
FIG. 6 is a left side elevation view of a key tab and key slot hinged connector of the present invention.
Figure 7:
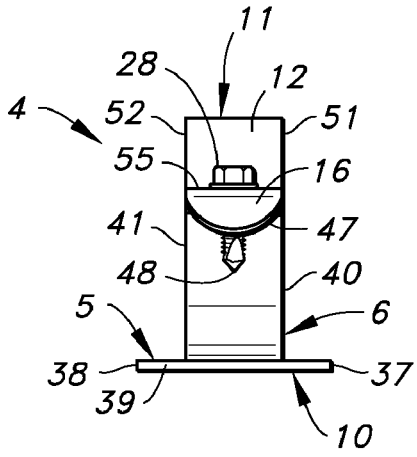
FIG. 7 is a right side elevation view of a key tab and key slot hinged connector of the present invention.
Figure 8:
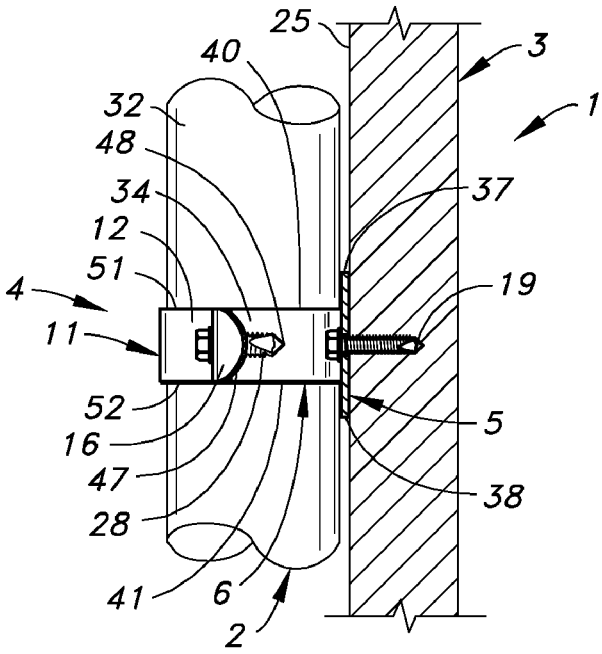
FIG. 8 is a right side, partially cross-sectional, elevation view of a key tab and key slot hinged connection of the present invention.

The present invention is a fence-frame-to-post connection 1. The connection 1 comprises an elongated fence post member 2, a fence frame member 3 disposed closely adjacent to the elongated post member 2, and a fence-frame-to-post connector 4 for attaching the frame member 3 and the post member 2. As shown in FIGS. 2, 10, 12 and 20 the fence post member 2 preferably supports connector 4, which supports the fence frame member 3, which supports a plurality of fence boards 30.

The connector 4 includes an interface member 5 and a retention member 11. Preferably, the interface member 5 is between the post member 2 and the frame member 3. The retention member 11 preferably clamps the post member 2 to the interface member 5.

The interface member 5 includes a central portion 6, first and second laterally-spaced fastening portions 8, and first and second interface portions 10. The interface member 5 preferably has a top edge 37, a bottom edge 38, and two side edges 39.

In the preferred embodiments shown in FIGS. 1-10, inclusive, the central portion 6, first and second laterally-spaced fastening portions 8, and first and second interface portions 10 are created by cutting two separate sections out of the interior of the interface member 5. This creates two interior openings 35 in the interface member 5, each having an inner edge 36. Preferably, the inner edges 36 are interrupted by two straight, vertical and mutually parallel bends; the inner edge 36 of each has two straight, horizontal and mutually parallel portions that are also parallel to the top edge 37 and the bottom edge 38 of the interface member 5; these horizontal portions are joined by arched portions near the two side edges 39. In these embodiments, the central portion 6, first and second laterally-spaced fastening portions 8, and first and second interface portions 10 have an upper edge 40 and a lower edge 41 at different levels than the top edge 37 and the bottom edge 38 of the whole interface member 5. The first and section interface portions 10 are the two horizontally-separated ends of the horizontally-oriented rectangle of the interface member 5.

In all preferred embodiments, the first and second laterally-spaced fastening portions 8, and the first and second interface portions 10 are substantially planar.

In the preferred embodiments shown in FIGS. 11-26, inclusive, the central portion 6, first and second laterally-spaced fastening portions 8, and first and second interface portions 10 occupy the vertical center of the interface member 5 and have an upper edge 40 and a lower edge 41 that are coincident with the top edge 37 and the bottom edge 38 of the whole interface member 5.

Preferably, the shape of the interface member 5 is horizontally symmetrical (the left and right sides mirroring each other), with a concave vertical cylinder section in the center of the central portion 6. The first and second ends 6 are the straight, vertical edges of the cylinder section, and the first and second laterally-spaced fastening portions 8 are planar rectangles, the inner sides of which are the first and second ends 6, the outer sides of which are parallel first and second outer edges 9, the same length as the first and second ends 6. The fastening portions 8 are parallel to the outer side 25 of the fence frame member 3. The first and second connection portions 23 are joined to the first and second ends 6 and angle toward the fence frame member 3. The connection portions 23 are also planar. The top edge 37 of the interface member 5 is horizontal in the central portion 6, through the fastening portions 8, and into the connection portions 23. The same is true of the bottom edge 38 of the interface member 5. Approximately midway through the connection portions 23, the top edge 37 and the bottom edge 38 both angle downward until they reach the first and second interface portions 10 of the interface member 5. The interface portions 10 branch out to either side of the connection portions 23, are planar, and are parallel to the outer side 25 of the fence frame member 3. The bottom edge 38 is horizontal in the interface portions 10, and the top edge 37 is horizontal and parallel except where the outermost upper corners of the interface member 5 are notched. The first and second support tabs 27 are planar, meet the bottom edges 38 of the interface portions 10 at ninety-degree angles, and point toward the fence boards 30, interfacing with the bottom side 26 of the fence frame member 3.

In all preferred forms, the central portion 6 is at least partially curvilinear, with an inner surface 31 that partially matches the outer surface 32 of the post member 2, which is preferably a vertically-oriented cylinder. In the preferred embodiments shown in FIGS. 1-10, inclusive, the curvilinear part 34 of the central portion 6 is interrupted where the central portion 6 attaches to the first and second interface portions 10. In the preferred embodiments shown in FIGS. 11-26, inclusive, the curvilinear part 34 of the central portion 6 is uninterrupted. In the preferred embodiments shown in FIGS. 1-10, inclusive, the central portion 6 includes two short spacer portions 33 that hold the frame member 3 away from the post member 2 so that moisture does not collect between the two. In the preferred embodiments shown in FIGS. 11-26, inclusive, the whole central portion 6 is held away from the frame member 3.

The retention member 11 includes a middle portion 12, third and fourth laterally-spaced fastening portions 14, and first and second tabs 16. In all of the preferred embodiments, the middle portion 12 of the retention member 11 is curvilinear, with an inner surface 42 that partially matches the outer surface 32 of the post member 2. In all of the preferred embodiments, the third and fourth laterally-spaced fastening portions 14, and the first and second tabs 16 are substantially planar.

A first plurality of fasteners 19 fastens the interface member 5 to the fence frame member 3. A second plurality of fasteners 28 fastens the retention member 11 to the interface member 5.

Preferably, fasteners 19 that fasten the interface member 5 to the fence frame member 3 are self-tapping wood screws 19. In the preferred embodiments shown in FIGS. 1-10, inclusive, one of the second plurality of fasteners 28 is a key tab 17 that interlocks with a key slot 18, forming a hinged connection 29 between the interface member 5 and the retention member 11. As shown, the key tab 17 is cut out of the material of the third laterally-spaced fastening portion 14 of the retention member 11 and is bent toward the interface member 5 and fence frame member 3. The key tab 17 has a constricted portion 43 that extends from the fastening portion 14 and the key tabs 17 ends in an expanded portion 44. The key slot 18 is cut in the first laterally-spaced fastening portion 8 of the interface member 5 and has a restricted portion 45 and an enlarged portion 46. The expanded portion 44 of the key tab 17 is passed through the enlarged portion 46 of the key slot 18 and the constricted portion 43 of the key tab 17 is then slid into the restricted portion 45 of the key slot 18, trapping the expanded portion of the key tab 17 on one side of the key slot 18 and preventing the key tab 17 from withdrawing from the key slot 18. The other of the second plurality of fasteners 28 is preferably a metal screw 28.

Although the key tab 17 is preferably part of the retention member 11 and the key slot 18 is preferably part of the interface member 5, the locations of the two can be reversed, so that the key tab 17 is in the interface member 5 and the key slot 18 is in the retention member 11. The disadvantage in such a reversal is that the key tab 17 would project out.

The central portion 6 of the interface member 5 partially encompasses the post member 2. The central portion 6 has first and second ends 7 laterally spaced from one another. Preferably, the first and second ends 7 are vertical and linear.

The first and second laterally-spaced fastening portions 8 of the interface member 5 are attached to the first and second ends 7 of the central portion 6. The first and second fastening portions 8 have first and second outer edges 9, respectively. The first and second outer edges 9 are laterally spaced away from the first and second ends 7, respectively, of the central portion 6. In the preferred embodiments shown in FIGS. 1-10, inclusive, the first and second outer edges 9 are arced.

The first and second interface portions 10 adjoin and are fastened to the fence frame member 3. Preferably, each of the first and second interface portions 10 is fastened with two fasteners 19. Preferably, each of the first and second interface portions 10 includes two fastener openings 49.

The middle portion 12 of the retention member 11 partially encompasses the post member 2. The middle portion 12 has third and fourth ends 13 laterally spaced from one another. Preferably, the third and fourth ends 13 are vertical and linear.

The third and fourth laterally-spaced fastening portions 14 of the retention member 11 are attached to the third and fourth ends 13 of the middle portion 12. The third and fourth fastening portions 14 have fifth and sixth ends 15 laterally spaced away from the third and fourth ends 13 of the middle portion 12. The third and fourth fastening portions 14 are fastened to the first and second fastening portions 8 of the interface member 5. Preferably, the fifth and sixth ends 15 are vertical and linear.

The first and second tabs 16 of the retention member 11 are angularly attached to the fifth and sixth ends 15 of the third and fourth fastening portions 14 along first and second bend lines 55, respectively. The first and second bend lines 55 are aligned with at least a portion of the first and second outer edges 9, respectively, of the first and second laterally-spaced fastening portions 8 of the interface member 5. This means that the retention member 11 is horizontally self-aligning against the interface member 5. Preferably, the first and second tabs 16 each have an arced outer edge 47.

A first plurality of fasteners 19, separate from the connector 4, fasten the first and second interface portions 10 of the interface member 5 to the fence frame member 3.

A second plurality of fasteners 28, separate from the first plurality of fasteners 19, fasten the third and fourth fastening portions 14 of the retention member 11 to the first and second fastening portions 8 of the interface member, respectively.

The first and second tabs 16 of the retention member 11 preferably are bent toward the fence frame member 3.

Preferably, at least one of the fasteners 28 of the second plurality of fasteners 28 has a pointed tip 48 oriented toward the fence frame member 3. The first and second tabs 16 shield the pointed tips 48 of the fasteners 28 of the second plurality of fasteners 28 that have pointed tips 48.

The central portion 6 of the interface member 5 preferably is channel-shaped. Preferably, the middle portion 12 of the retention member 11 is also channel-shaped.

The first and second interface portions 10 of the interface member 5 preferably extend laterally beyond the first and second laterally-spaced fastening portions 8, respectively.

Preferably, each of the first and second tabs 16 is attached to one of the fifth and sixth ends 15 at an angle that is neither 90 nor 180 degrees.

The first and second interface portions 10 of the interface member 5 preferably interface with and are fastened to the fence frame member 3. The middle portion 12 of the retention member 11 registers with and partially embraces the post member 2.

Preferably, the interface member 5 is joined to the retention member 11 by a hinged connection 29.

The third fastening portion 14 of the retention member 11 preferably is fastened to the first fastening portion 8 of the interface member 5 with an integral key tab 17 that extends from the third fastening portion 14 and is received by a key slot 18 in the first fastening portion 8. The integral key tab 17 and the key slot form the hinged connection 29.

Preferably, the fourth fastening portion 14 of the retention member 11 is fastened to the second fastening portion 8 of the interface member 5 with a separate fastener 28.

The first plurality of fasteners 19 preferably are identical to each other. Preferably, the second plurality of separate fasteners 28 are identical to each other when not in a hinged connection.

In the embodiments shown in FIGS. 11-18, the first and second fastening portions 8 each preferably supports a nut 20 that receives one of the second plurality of fasteners 28.

Preferably, the first and second fastening portions 8 each supports one of the nuts 20 with a dimple 21 in each of the first and second fastening portions 8.

Figure 14:
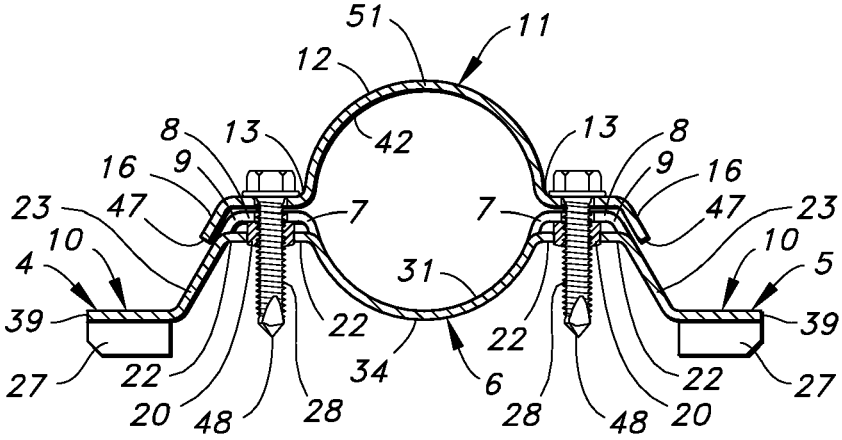
FIG. 14 is a top plan, partially cross-sectional view of a connector of the present invention in which the connector halves are joined by a plurality of separate fasteners.
Figure 15:
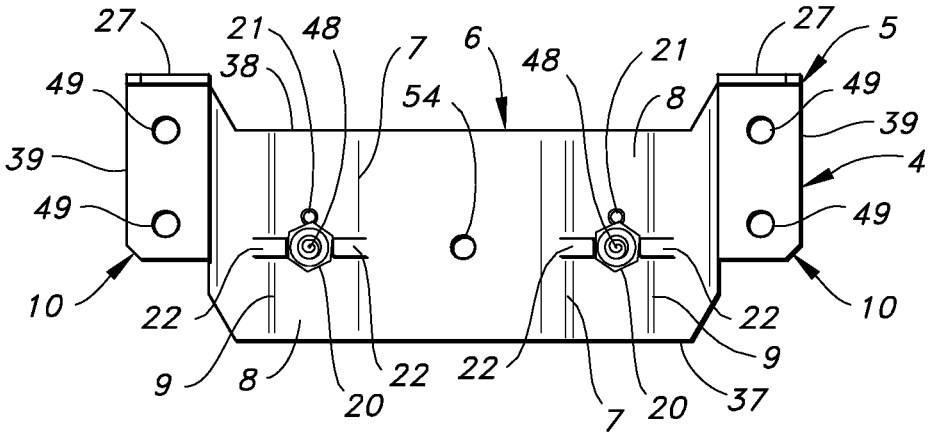
FIG. 15 is a inverted rear elevation view of a connector of the present invention in which the connector halves are joined by a plurality of separate fasteners.
Figure 16:
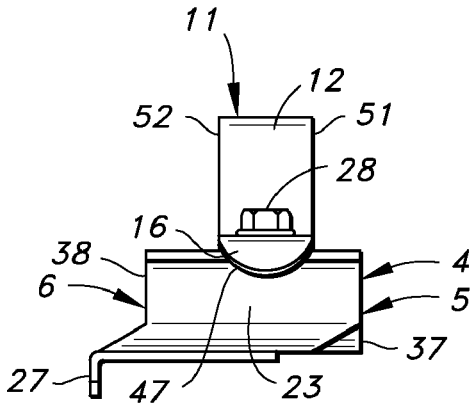
FIG. 16 is a right side elevation view of a connector of the present invention in which the connector halves are joined by a plurality of separate fasteners.
Figure 17:
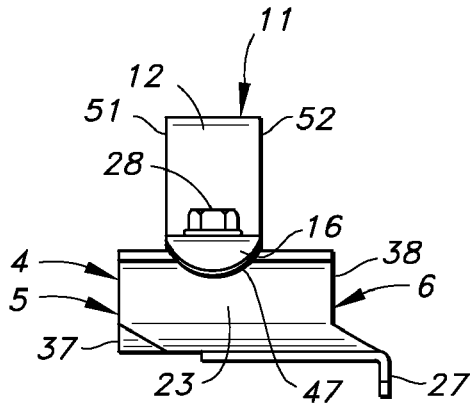
FIG. 17 is a left side elevation view of a connector of the present invention in which the connector halves are joined by a plurality of separate fasteners.
Figure 18:
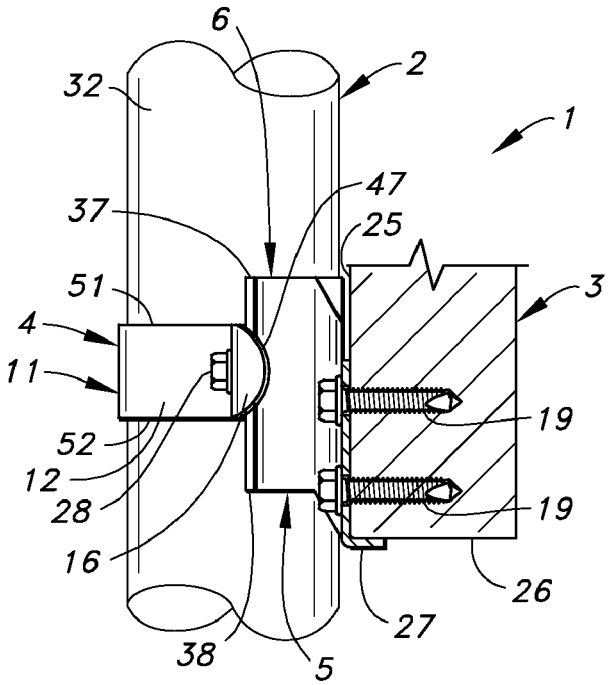
FIG. 18 is a right side, partially cross-sectional elevation view of a connection of the present invention in which the connector halves are joined by a plurality of separate fasteners.
Figure 19:
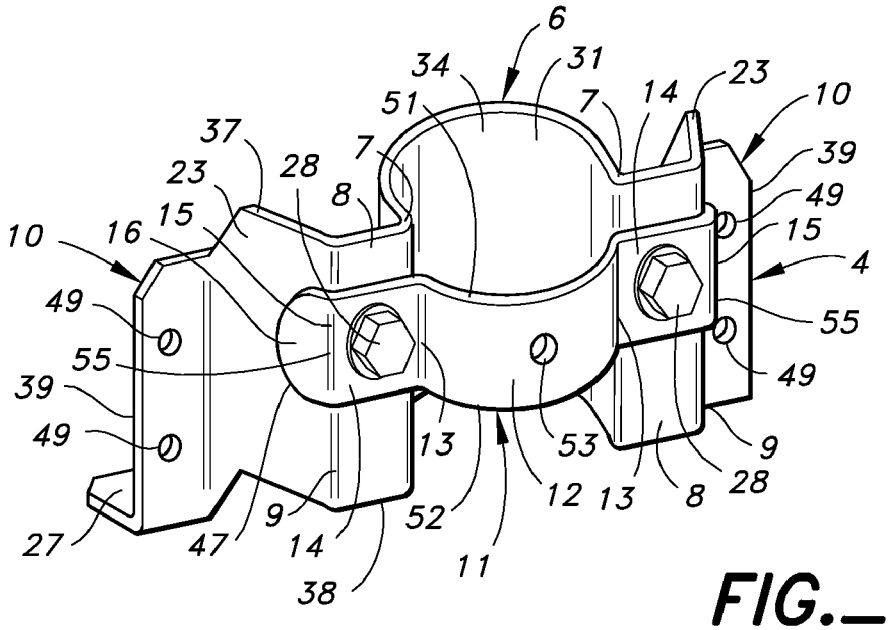
FIG. 19 is a perspective view of another connector of the present invention in which the connector halves are joined by a plurality of separate fasteners.
Figure 20:
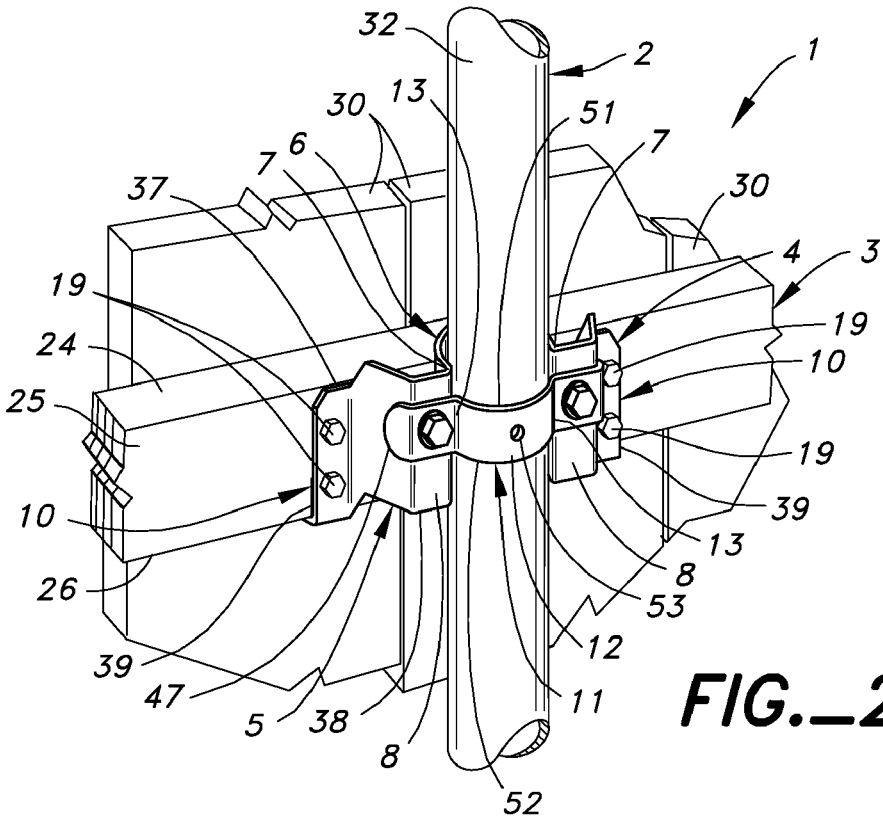
FIG. 20 is a perspective view of another connection of the present invention in which the connector halves are joined by a plurality of separate fasteners.
Figure 21:
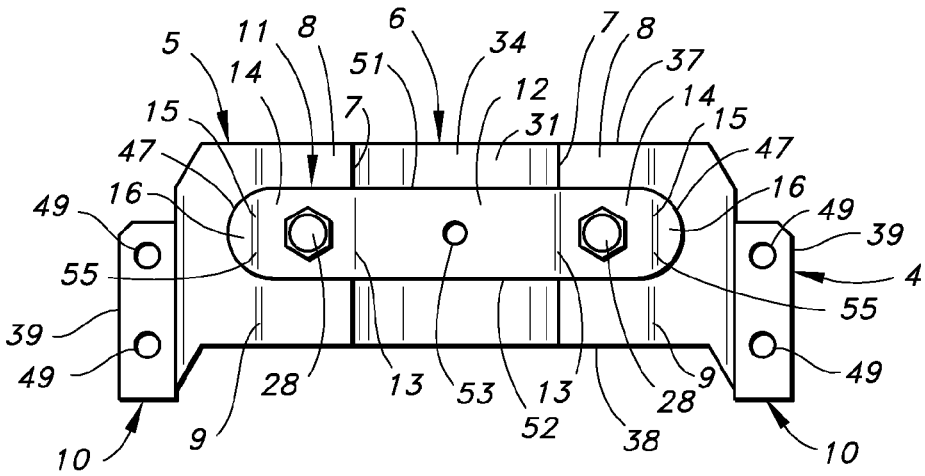
FIG. 21 is a front elevation view of another connector of the present invention in which the connector halves are joined by a plurality of separate fasteners.
Figure 22:
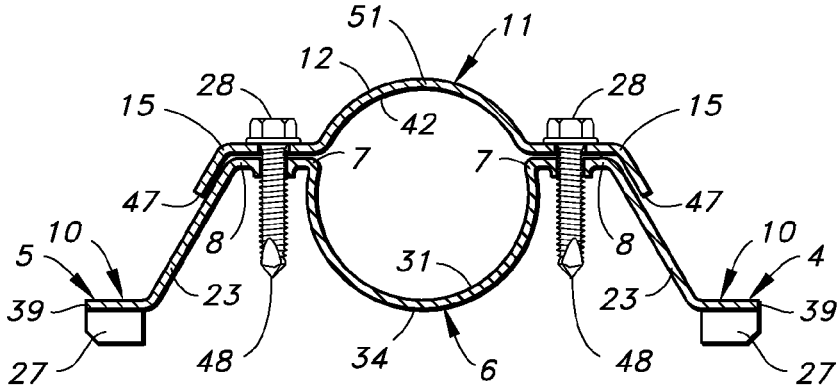
FIG. 22 is a top plan, partially cross-sectional view of another connector of the present invention in which the connector halves are joined by a plurality of separate fasteners.
Figure 23:
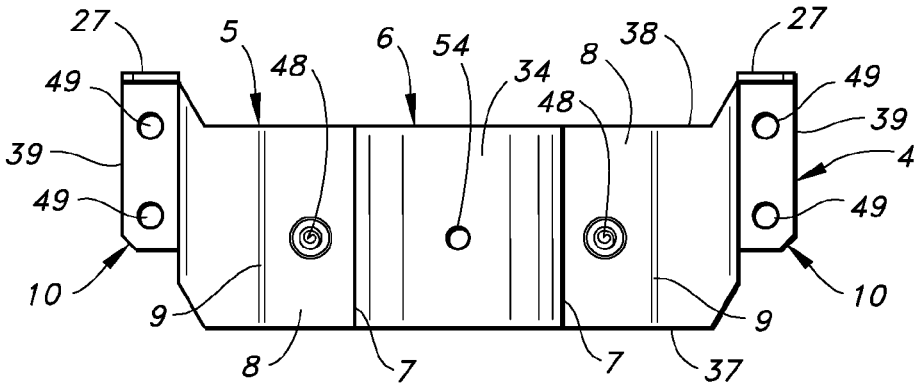
FIG. 23 is an inverted rear elevation view of another connector of the present invention in which the connector halves are joined by a plurality of separate fasteners.
Figure 24:
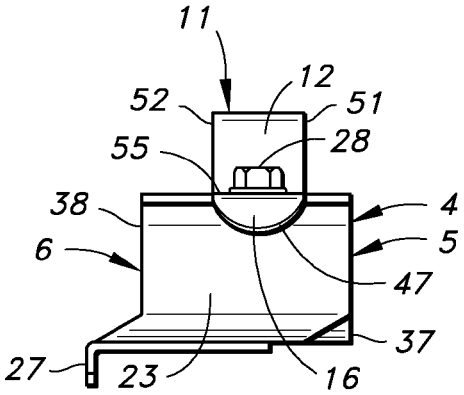
FIG. 24 is a right side elevation view of another connector of the present invention in which the connector halves are joined by a plurality of separate fasteners.
Figure 25:
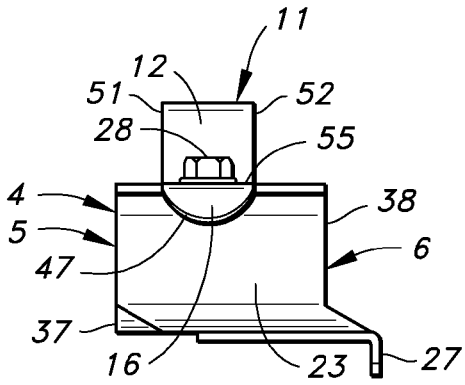
FIG. 25 is a left side elevation view of another connector of the present invention in which the connector halves are joined by a plurality of separate fasteners.
Figure 26:
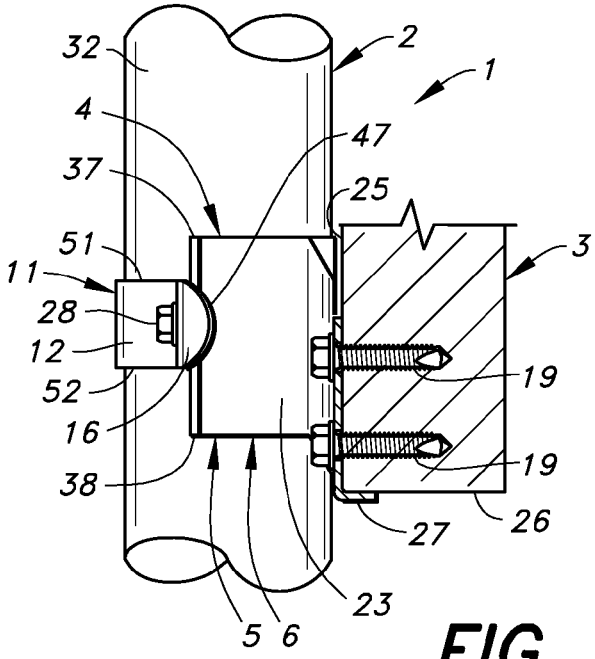
FIG. 26 is a right side, partially cross-sectional, elevation view of another connection of the present invention in which the connector halves are joined by a plurality of separate fasteners.
Figure 27:
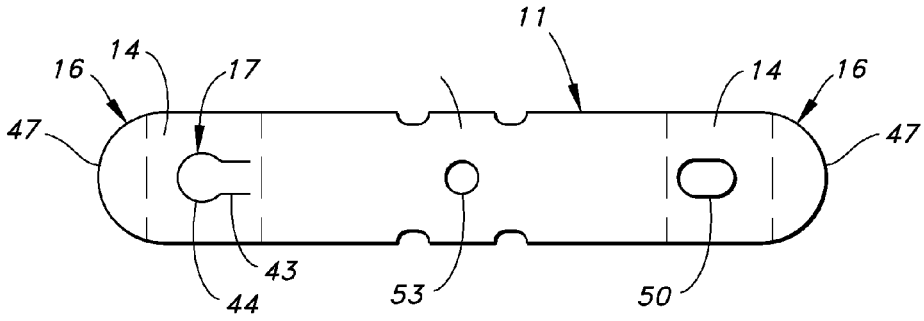
FIG. 27 is a top plan view of the sheet metal blank of the retention member of a key tab and key slot hinged connector of the present invention.
Figure 28:
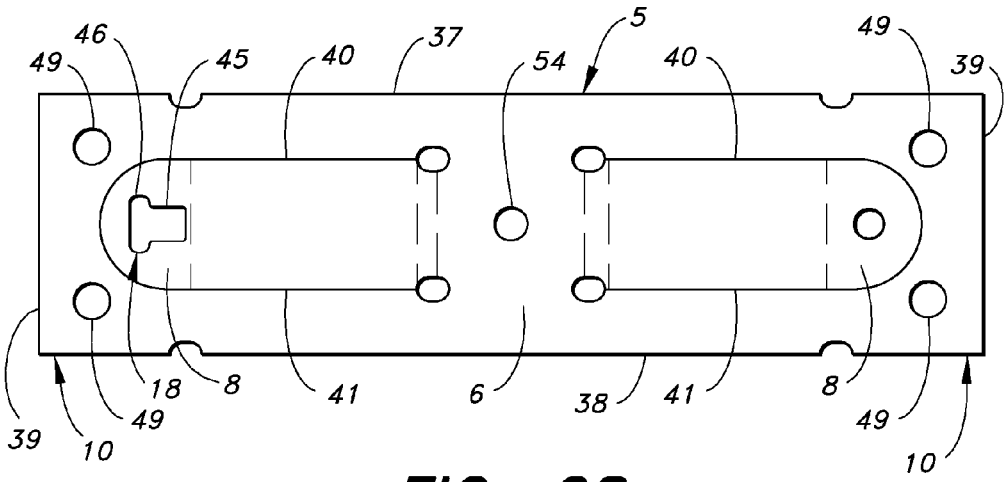
FIG. 28 is a top plan view of the sheet metal blank of the interface member of a key tab and key slot hinged connector of the present invention.

As shown in FIGS. 14 and 15, the first and second interface portions 10 preferably are connected to the first and second fastener-receiving portions 8 by intervening first and second connection portions 23 that are attached to the first and second outer edges 9 of the fastening portions 8 and are angularly related to both the interface portions 10 and the fastening portions 8. Preferably, the first connection portion 23 of the interface member 5 includes a nut-restraining tab 22 that restrains the nut 20 that is supported by the dimple 21 in the first fastening portion 8 against rotation. The second connection portion 23 of the interface member 5 preferably includes a nut-restraining tab 22 that restrains the nut 20 that is supported by the dimple 21 in the first fastening portion 8 against rotation. The nut-restraining tabs 22 are cut out of the central material of the first and second connection portions 23 of the interface member 5 adjacent the first and second outer edges 9 of the first and second fastening portions. Preferably, matching nut-restraining tabs 22 are cut out of the central material of the central portion 6 of the interface member 5 adjacent the first and second ends 7 of the central portion 6.

Preferably, as shown in FIGS. 11-26, inclusive, the first and second interface portions 10 are connected to the first and second fastener-receiving portions 8 by intervening first and second connection portions 23 that are attached to the first and second outer edges 9 of the fastening portions 8 and are angularly related to both the interface portions 10 and the fastening portions 8. The angle between the first and second connection portions 23 and the fastening portions 8 is the same as the angle of the attachment between the first and second tabs 16 and the fifth and sixth ends 15 of the retention member 11.

The fence frame member 3 preferably is a substantially horizontal fence runner 3 with a top side 24, an outer side 25, and a bottom side 26. The interface member 5 includes first and second support tabs 27 projecting from the first and second interface portions 10 and interfacing with the bottom side 26 of the fence runner 3.

Preferably, the majority of the post member 2 is a cylinder having a radius dimension, and the central portion 6 of the interface member 5 has a radius dimension substantially equal to or greater than the radius dimension of the post member.

The post member 2 preferably is metal. Preferably, the frame member 3 is wood.

The post member 2 preferably has a circumference dimension, and the central portion 6 of the interface member 5 has an arc dimension greater than half of the circumference dimension of the post member 2.

The present invention includes a method of forming a fence-frame-to-post connection 1. The method comprises providing an elongated fence post member 2, disposing a fence frame member 3, providing a fence-frame-to-post connector 4, snapping the post member 2 into place, closing the connector 4 and fastening the connector 4 to the fence frame member 3.

The majority of the elongated fence post member 2 is a cylinder having a radius dimension and a circumference dimension. The fence frame member 3 is disposed closely adjacent to the elongated post member 2. The fence-frame-to-post connector 4 is for attaching the frame member 3 and the post member 2.

The connector 4 includes an interface member 5 and a retention member 11.

The interface member 5 includes a central portion 6, first and second laterally-spaced fastening portions 8, and first and second interface portions 10.

The central portion 6 partially encompasses the post member 2. The central portion 6 has first and second ends 7 laterally spaced from one another. The first and second laterally-spaced fastening portions 8 are attached to the first and second ends 7 of the central portion 6. The first and second fastening portions 8 have first and second outer edges 9, respectively. The first and second outer edges 9 are laterally spaced away from the first and second ends 7, respectively, of the central portion 6. The first and second interface portions 10 adjoin and are fastened to the fence frame member 3.

The retention member 11 includes a middle portion 12, third and fourth laterally-spaced fastening portions 14, and first and second tabs 16.

The middle portion 12 partially encompasses the post member 2. The middle portion 12 has third and fourth ends 13 laterally spaced from one another. Third and fourth laterally-spaced fastening portions 14 are attached to the third and fourth ends 13 of the middle portion 12. The third and fourth fastening portions 14 have fifth and sixth ends 15 laterally spaced away from the third and fourth ends 13 of the middle portion 12. The third and fourth fastening portions 14 are fastened to the first and second fastening portions 8 of the interface member 5. First and second tabs 16 are angularly attached to the fifth and sixth ends 15 of the third and fourth fastening portions 14 along first and second bend lines 55, respectively. The first and second bend lines 55 are aligned with at least a portion of the first and second outer edges 9, respectively, of the first and second laterally-spaced fastening portions 8 of the interface member 5.

The post member 2 is snapped into the central portion 6 of the interface member 5. The third fastening portion 14 of the retention member 11 is fastened to the first fastening portion 8 of the interface member 5. The fourth fastening portion 14 of the retention member 11 is fastened to the second fastening portion 8 of the interface member 5.

Preferably, the first and second interface portions 10 of the interface member 5 interface with and are fastened to the fence frame member 3. The middle portion 12 of the retention member 11 registers with and partially embraces the post member 2.

The present invention includes another method of forming a fence-frame-to-post connection 1. This method also comprises providing an elongated fence post member 2, disposing a fence frame member 3, providing a fence-frame-to-post connector 4, snapping the post member 2 into place, closing the connector 4 and fastening the connector 4 to the fence frame member 3.

An elongated fence post member 2 is provided, a fence frame member 3 is disposed closely adjacent to the elongated post member 2, and a fence-frame-to-post connector 4 for attaching the frame member 3 and the post member 2 is provided.

The connector 4 includes an interface member 5 and a retention member 11.

The interface member 5 includes a central portion 6, first and second laterally-spaced fastening portions 8, and first and second interface portions 10.

The central portion 6 partially encompasses the post member 2. The central portion 6 has first and second ends 7 laterally spaced from one another. The first and second laterally-spaced fastening portions 8 are attached to the first and second ends 7 of the central portion 6. The first and second fastening portions 8 have first and second outer edges 9, respectively. The first and second outer edges 9 are laterally spaced away from the first and second ends 7, respectively, of the central portion 6. The first and second interface portions 10 adjoin and are fastened to the fence frame member 3.

The retention member 11 includes a middle portion 12, third and fourth laterally-spaced fastening portions 14, and first and second tabs 16.

The middle portion 12 partially encompasses the post member 2. The middle portion 12 has third and fourth ends 13 laterally spaced from one another. Third and fourth laterally-spaced fastening portions 14 are attached to the third and fourth ends 13 of the middle portion 12. The third and fourth fastening portions 14 have fifth and sixth ends 15 laterally spaced away from the third and fourth ends 13 of the middle portion 12. The third and fourth fastening portions 14 are fastened to the first and second fastening portions 8 of the interface member 5. First and second tabs 16 are angularly attached to the fifth and sixth ends 15 of the third and fourth fastening portions 14 along first and second bend lines 55, respectively. The first and second bend lines 55 are aligned with at least a portion of the first and second outer edges 9, respectively, of the first and second laterally-spaced fastening portions 8 of the interface member 5.

The third fastening portion 14 of the retention member 11 is fastened to the first fastening portion 8 of the interface member 5 with an integral key tab 17 that extends from the third fastening portion 14 and is received by a key slot 18 in the first fastening portion 8.

The retention member 11 is pivoted on the interface between the integral key tab 17 and the key slot 18 to bring the fourth fastening portion 14 of the retention member 11 together with the second fastening portion 8 of the interface member 5

The fourth fastening portion 14 of the retention member 11 is fastened to the second fastening portion 8 of the interface member 5 with a separate fastener 28.

Preferably, the first and second interface portions 10 of the interface member 5 interface with the fence frame member 3. The middle portion 12 of the retention member 11 registers with the post member 2.

In a preferred embodiment, the fence-frame-to-post connection 1 comprises an elongated fence post member 2, a fence frame member 3, and a fence-frame-to-post connector 4.

The fence frame member 3 is disposed closely adjacent to the elongated post member 2. The fence-frame-to-post connector 4 attaches the frame member 3 and the post member 2.

The connector 4 includes an interface member 5 and a retention member 11.

The interface member 5 includes a central portion 6, first and second laterally-spaced fastening portions 8, and first and second interface portions 10. The retention member 11 includes a middle portion 12, third and fourth laterally-spaced fastening portions 14. The interface member 5 is joined to the retention member 11 by a hinged connection 29.

The central portion 6 of the interface member 5 partially encompasses the post member 2. The central portion 6 has first and second ends 7 laterally spaced from one another. The first and second laterally-spaced fastening portions 8 of the interface member 5 are attached to the first and second ends 7 of the central portion 6. The first and second fastening portions 8 have first and second outer edges 9, respectively. The first and second outer edges 9 are laterally spaced away from the first and second ends 7, respectively, of the central portion 6. The first and second interface portions 10 adjoin and are fastened to the fence frame member 3.

The middle portion 12 of the retention member 12 partially encompasses the post member 2. The middle portion 12 has third and fourth ends 13 laterally spaced from one another. The third and fourth laterally-spaced fastening portions 14 are attached to the third and fourth ends 13 of the middle portion 12. The third and fourth fastening portions 14 have fifth and sixth ends 15 laterally spaced away from the third and fourth ends 13 of the middle portion 12. The third and fourth fastening portions 14 are fastened to the first and second fastening portions 8 of the interface member 5.

Preferably, the third fastening portion 14 of the retention member 11 is fastened to the first fastening portion 8 of the interface member 5 with an integral key tab 17 that extends from the third fastening portion 14 and is received by a key slot 18 in the first fastening portion 8. The integral key tab 17 and the key slot form the hinged connection 29. The fourth fastening portion 14 of the retention member 11 is fastened to the second fastening portion 8 of the interface member 5 with a separate fastener 28.

Alternately, the hinged connection 29 can be a barrel-and-pin hinge 28, or the hinged connection 29 can be a strap hinge 28.

Preferably, first and second tabs 16 are angularly attached to the fifth and sixth ends 15 of the third and fourth fastening portions 14 along first and second bend lines 55, respectively. The first and second bend lines 55 are aligned with at least a portion of the first and second outer edges 9, respectively, of the first and second laterally-spaced fastening portions 8 of the interface member 5.

The connector 4 is preferably formed from 12 gauge G90 A-653 SS Gf33 galvanized sheet steel, with a minimum thickness of 0.099 inches, a minimum yield strength of 33 ksi, and a minimum tensile strength of 45 ksi, but any other suitable material can be used.

Figure 9:
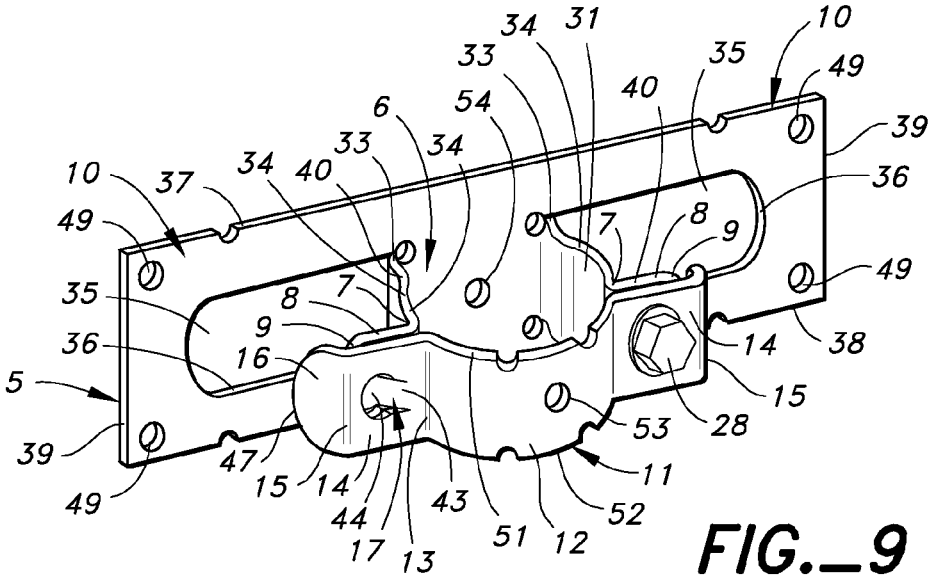
FIG. 9 is a perspective view of another key tab and key slot hinged connector of the present invention.
Figure 10:
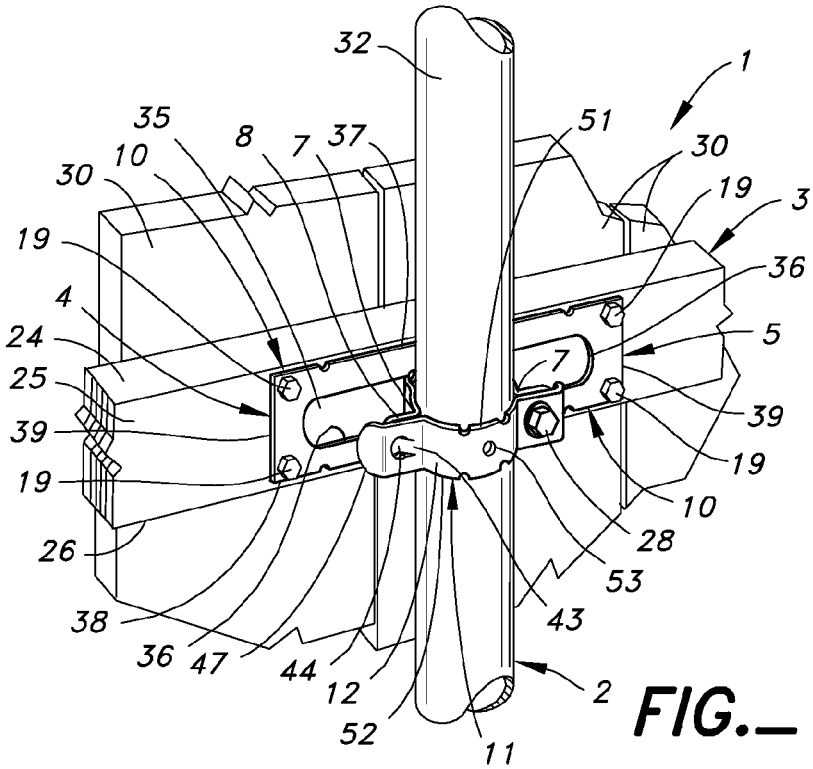
FIG. 10 is a perspective view of another key tab and key slot hinged connection of the present invention.
Figure 11:
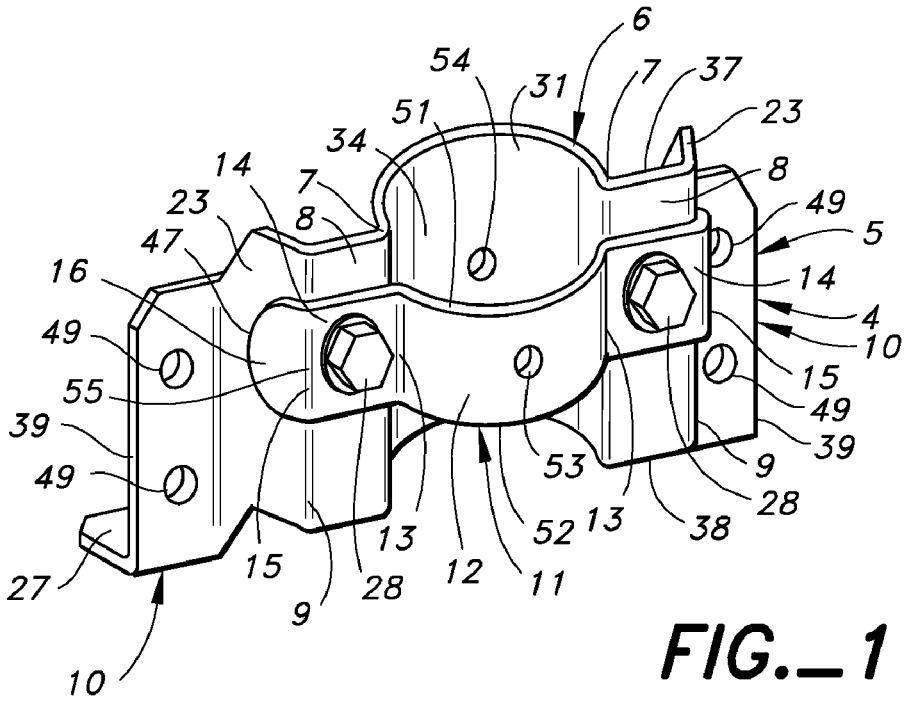
FIG. 11 is a perspective view of a connector of the present invention in which the connector halves are joined by a plurality of separate fasteners.
Figure 12:
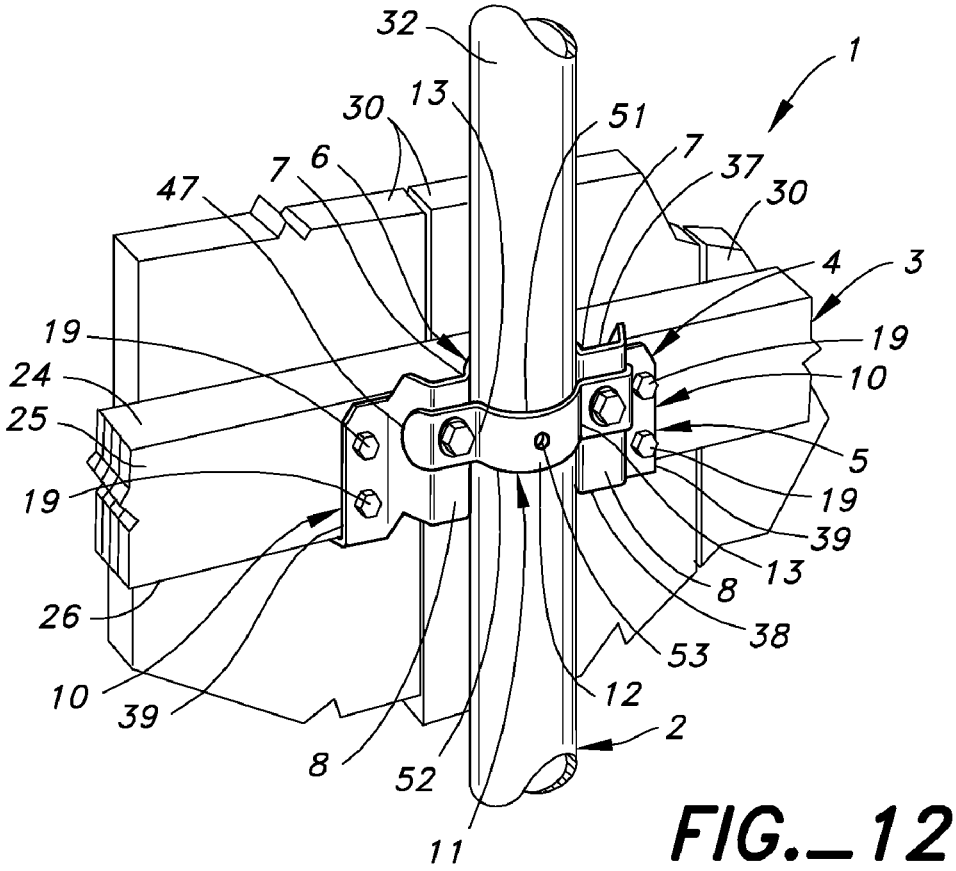
FIG. 12 is a perspective view of a connection of the present invention in which the connector halves are joined by a plurality of separate fasteners.
Figure 13:
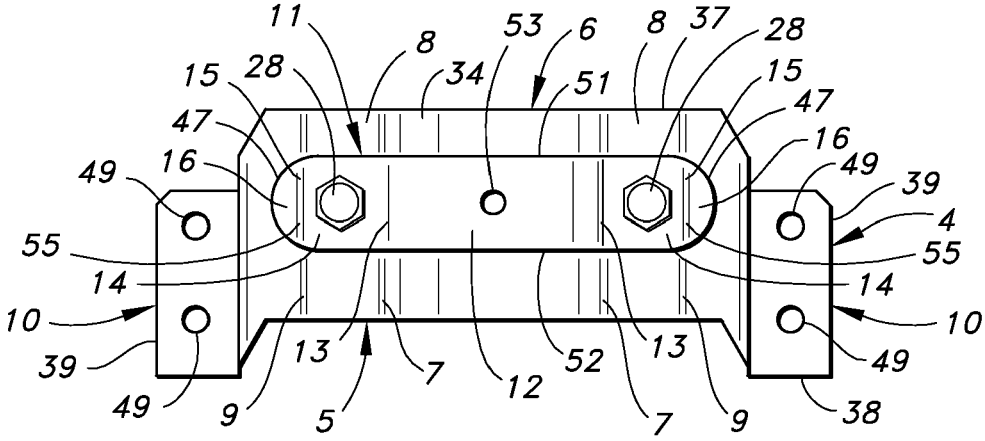
FIG. 13 is a front elevation view of a connector of the present invention in which the connector halves are joined by a plurality of separate fasteners.

In the most preferred form of the invention, best shown in FIGS. 9 and 10, the greatest distance between the arced outer edges 47 of the retention member 11 is 5 19/32 inches. The retention member 11 preferably has an upper edge 51 and a lower edge 52 and these are 1 inch apart and generally parallel. Preferably, there is an obround fastener opening 50 in the fourth fastening portion 11 with a width of 7/16 inches and a width of 9/32 inches. The fastener opening is preferably 11/16 inches from the most distant part of the nearest arced outer edge 47. The key tab 17 is preferably 9/16 inches long and 5/8 inches away from the most distant part of the nearest arced outer edge 47. The center of the expanded portion 44 of the key tab 17 is 13/16 inches away from the most distant part of the nearest arced outer edge 47. Preferably, there is an additional round opening 53 in the center of the retention member 11.

In the most preferred form of the invention, best shown in FIGS. 9 and 10, the fastener openings 49 in the interface member 5 are round and 9/32 inches in diameter. These fastener openings 49 preferably are centered 13/32 inches from the nearest of the top edge 37 and the bottom edge 38 of the interface member 5. Preferably, the top edge 37 and bottom edge 38 of the interface member 5 are 2 inches apart and generally parallel. The distance between the bottom edge 38 of the whole interface member 5 and the lower edge 41 of the central portion 6 preferably is ½ inches. Preferably, the side edges 39 of the interface member 5 are 7¼ inches apart and generally parallel. The restricted portion 45 of the key slot 18 is preferably ¼ inches squared. The enlarged portion 46 of the key slot 18 preferably extends 3/16 inches beyond the restricted portion 45 and preferably is 7/16 inches wide. Preferably, the enlarged portion 46 of the key slot 18 is 11/16 inches from the first outer edge 9 of the first fastening portion 8 of the interface member 5. Preferably, there is an additional round opening 54 in the center of the interface member 5.

I claim:

1. A fence-frame-to-post connection (1) comprising:

a. an elongated fence post member (2);

b. a fence frame member (3) disposed closely adjacent to said elongated post member (2);

c. a fence-frame-to-post connector (4) for attaching said frame member (3) and said post member (2), said connector (4) including:

i. an interface member (5) including:

1. a central portion (6), said central portion (6) partially encompassing said post member (2), said central portion (6) having first and second ends (7) laterally spaced from one another;
2. first and second laterally-spaced fastening portions (8) attached to said first and second ends (7) of said central portion (6), said first and second fastening portions (8) being substantially planar and having first and second outer edges (9), respectively, said first and second outer edges (9) being laterally spaced away from said first and second ends (7), respectively, of said central portion (6); and
3. first and second interface portions (10) adjoining and being fastened to said fence frame member (3);

ii. a retention member (11) including:

1. a middle portion (12), said middle portion (12) partially encompassing said post member (2), said middle portion (12) having third and fourth ends (13) laterally spaced from one another;
2. third and fourth laterally-spaced fastening portions (14) attached to said third and fourth ends (13) of said middle portion (12), said third and fourth fastening portions (14) being substantially planar and having fifth and sixth ends (15) laterally spaced away from said third and fourth ends (13) of said middle portion (12), said third and fourth fastening portions (14) being fastened to said first and second fastening portions (8) of said interface member (5); and 3. first and second tabs (16) angularly attached to said fifth and sixth ends (15) of said third and fourth fastening portions (14) along first and second bend lines (55), respectively, said first and second bend lines (55) being aligned with at least a portion of said first and second outer edges (9), respectively, of said first and second laterally-spaced fastening portions (8) of said interface member (5); wherein:

d. a first plurality of fasteners (19), separate from said connector (4), fastens said first and second interface portions (10) of said interface member (5) to said fence frame member (3);

e. a second plurality of fasteners (28), separate from said first plurality of fasteners (19), fastens said third and fourth fastening portions (14) of the retention member (11) to the first and second fastening portions (8) of the interface member (5), respectively; wherein f. said first and second tabs (16) extend toward said fence frame member (3), g. at least one fastener (28) of said second plurality of fasteners (28) has a pointed tip (48) oriented toward said fence frame member (3), h. said first and second tabs are substantially as wide as said third and fourth laterally-spaced fastening portions (14) and substantially wider than said pointed tip (48) of said at least one fastener (28), i. and one of said first and second tabs (16) and one side of said central portion (6) bracket said pointed tip (48) of said at least one fastener (28) and said fence frame member (3) is disposed opposite said pointed tip (48) of said fastener (28), all being in close enough proximity to shield said pointed tip (48) of said at least one fastener (28).

2. The fence-frame-to-post connection (1) of claim 1, wherein:

a. said central portion (6) of said interface member (5) is channel-shaped, and b. said tabs (16) are substantially planar and each have an arced outer edge (47).

3. The fence-frame-to-post connection (1) of claim 2, wherein:

a. the majority of said post member (2) is a cylinder having a radius dimension;

b. said central portion (6) of said interface member (5) has a radius dimension substantially equal to or greater than said radius dimension of said post member.

4. The fence-frame-to-post connection (1) of claim 3, wherein:

a. said post member (2) is metal.

5. The fence-frame-to-post connection (1) of claim 4, wherein:

a. said frame member (3) is wood.

6. The fence-frame-to-post connection (1) of claim 2, wherein:

a. said post member (2) has a circumference dimension; and b. said central portion (6) of said interface member (5) has an arc dimension greater than half of said circumference dimension of said post member (2).

7. The fence-frame-to-post connection (1) of claim 1, wherein:

a. said middle portion (12) of said retention member (11) is channel-shaped.

8. The fence-frame-to-post connection (1) of claim 1, wherein:

a. said first and second interface portions (10) of said interface member (5) extend laterally beyond said first and second laterally-spaced fastening portions (8), respectively.

9. The fence-frame-to-post connection (1) of claim 1, wherein:

a. each of said first and second tabs (16) is attached to one of said fifth and sixth ends (15) at an angle that is neither 90 nor 180 degrees.

10. The fence-frame-to-post connection (1) of claim 1, wherein:

a. said first and second interface portions (10) of said interface member (5) interface with and are fastened to said fence frame member (3); and b. said middle portion (12) of said retention member (11) registers with and partially embraces said post member (2).

11. The fence-frame-to-post connection (1) of claim 1, wherein:

a. said interface member (5) is joined to said retention member (11) by a hinged connection (29), wherein b. said third fastening portion (14) of said retention member (11) is fastened to said first fastening portion (8) of said interface member (5) with an integral key tab (17) that is cut out of the material of the third fastening portion (14) distal of said fifth end (15) and has a constricted portion (43) and ends in an expanded portion (44), said key tab (17) extending from said third fastening portion (14) and being received by a key slot (18) having an enlarged portion (46) and a restricted portion (45) and wherein said constricted portion (43) of said key tab (17) is received by a restricted portion (45) in said first fastening portion (8) and said expanded portion (44) is disposed on said side of said first fastening portion (8) closer to said fence frame member (3), said integral key tab (17) and said key slot forming said hinged connection (29); and c. said fourth fastening portion (14) of said retention member (11) is fastened to said second fastening portion (8) of said interface member (5) with a separate fastener (28).

12. The fence-frame-to-post connection (1) of claim 1, wherein:

a. said first plurality of fasteners (19) are identical to each other; and b. said second plurality of separate fasteners (28) are identical to each other.

13. The fence-frame-to-post connection (1) of claim 1, wherein:

a. said first and second fastening portions (8) each supports a nut (20) that receives one of said second plurality of screws (19).

14. The fence-frame-to-post connection (1) of claim 13, wherein:

a. said first and second fastening portions (8) each supports one of said nuts (20) with a dimple (21) in each of said first and second fastening portions (8).

15. The fence-frame-to-post connection (1) of claim 14, wherein:

a. said first and second interface portions (10) are connected to said first and second fastener-receiving portions (8) by intervening first and second connection portions (23) that are attached to said first and second outer edges (9) of said fastening portions (8) and are angularly related to both said interface portions (10) and said fastening portions (8); and b. said first connection portion (23) of said interface member (5) includes a nut-restraining tab (22) that restrains said nut (20) that is supported by said dimple (21) in said first fastening portion (8) against rotation; and c. said second connection portion (23) of said interface member (5) includes a nut-restraining tab (22) that restrains said nut (20) that is supported by said dimple (21) in said first fastening portion (8) against rotation.

16. The fence-frame-to-post connection (1) of claim 15, wherein:

a. said first and second interface portions (10) are connected to said first and second fastener-receiving portions (8) by intervening first and second connection portions (23) that are attached to said first and second outer edges (9) of said fastening portions (8) and are angularly related to both said interface portions (10) and said fastening portions (8); and b. the angle between said first and second connection portions (23) and said fastening portions (8) is the same as the angle of the attachment between said first and second tabs (16) and said fifth and sixth ends (15) of said retention member (11).

17. The fence-frame-to-post connection (1) of claim 1, wherein:

a. said fence frame member (3) is a substantially horizontal fence runner (3) with a top side (24), an outer side (25), and a bottom side (26); and b. said interface member (5) includes first and second support tabs (27) projecting from said first and second interface portions (10) and interfacing with said bottom side (26) of said fence runner (3).

18. A method of forming a fence-frame-to-post connection (1) comprising:

a. providing an elongated fence post member (2), the majority of which is a cylinder having a radius dimension and a circumference dimension;

b. disposing a fence frame member (3) closely adjacent to said elongated post member (2);

c. providing a fence-frame-to-post connector (4) for attaching said frame member (3) and said post member (2), said connector (4) including:

i. an interface member (5) including:

1. a central portion (6), said central portion (6) partially encompassing said post member (2), said central portion (6) having first and second ends (7) laterally spaced from one another;

2. first and second laterally-spaced fastening portions (8) attached to said first and second ends (7) of said central portion (6), said first and second fastening portions (8) being substantially planar and having first and second outer edges (9), respectively, said first and second outer edges (9) being laterally spaced away from said first and second ends (7), respectively, of said central portion (6); and 3. first and second interface portions (10) adjoining and being fastened to said fence frame member (3);

ii. a retention member (11) including:

1. a middle portion (12), said middle portion (12) partially encompassing said post member (2), said middle portion (12) having third and fourth ends (13) laterally spaced from one another;

2. third and fourth laterally-spaced fastening portions (14) attached to said third and fourth ends (13) of said middle portion (12), said third and fourth fastening portions (14) being substantially planar and having fifth and sixth ends (15) laterally spaced away from said third and fourth ends (13) of said middle portion (12), said third and fourth fastening portions (14) being fastened to said first and second fastening portions (8) of said interface member (5); and 3. first and second tabs (16) angularly attached to said fifth and sixth ends (15) of said third and fourth fastening portions (14) along first and second bend lines (55), respectively, said first and second bend lines (55) being aligned with at least a portion of said first and second outer edges (9), respectively, of said first and second laterally-spaced fastening portions (8) of said interface member (5);

d. snapping said post member (2) into said central portion (6) of said interface member (5);

e. fastening said third fastening portion (14) of said retention member (11) to said first fastening portion (8) of said interface member (5) with at least one fastener (28); and f. fastening said fourth fastening portion (14) of said retention member (11) to said second fastening portion (8) of said interface member (5) with at least one fastener (28); wherein g. said first and second tabs (16) extend toward said fence frame member (3), h. at least one fastener (28) of said second plurality of fasteners (28) has a pointed tip (48) oriented toward said fence frame member (3), i. said first and second tabs are substantially as wide as said third and fourth laterally-spaced fastening portions (14) and substantially wider than said pointed tip (48) of said at least one fastener (28), j. and one of said first and second tabs (16) and one side of said central portion (6) bracket said pointed tip (48) of said at least one fastener (28) and said fence frame member (3) is disposed opposite said pointed tip (48) of said fastener (28), all being in close enough proximity to shield said pointed tip (48) of said at least one fastener (28).

19. The method of forming a fence-frame-to-post connection (1) of claim 18, wherein:

a. said first and second interface portions (10) of said interface member (5) interface with and are fastened to said fence frame member (3); and b. said middle portion (12) of said retention member (11) registers with and partially embraces said post member (2).

20. A method of forming a fence-frame-to-post connection (1) comprising:

a. providing an elongated fence post member (2);

b. disposing a fence frame member (3) closely adjacent to said elongated post member (2);

c. providing a fence-frame-to-post connector (4) for attaching said frame member (3) and said post member (2), said connector (4) including:

i. an interface member (5) including:

1. a central portion (6), said central portion (6) partially encompassing said post member (2), said central portion (6) having first and second ends (7) laterally spaced from one another;

2. first and second laterally-spaced fastening portions (8) attached to said first and second ends (7) of said central portion (6), said first and second fastening portions (8) being substantially planar and having first and second outer edges (9), respectively, said first and second outer edges (9) being laterally spaced away from said first and second ends (7), respectively, of said central portion (6); and 3. first and second interface portions (10) adjoining and being fastened to said fence frame member (3);

ii. a retention member (11) including:

1. a middle portion (12), said middle portion (12) partially encompassing said post member (2), said middle portion (12) having third and fourth ends (13) laterally spaced from one another;
2. third and fourth laterally-spaced fastening portions (14) attached to said third and fourth ends (13) of said middle portion (12), said third and fourth fastening portions (14) being substantially planar and having fifth and sixth ends (15) laterally spaced away from said third and fourth ends (13) of said middle portion (12), said third and fourth fastening portions (14) being fastened to said first and second fastening portions (8) of said interface member (5); and
3. first and second tabs (16) angularly attached to said fifth and sixth ends (15) of said third and fourth fastening portions (14) along first and second bend lines (55), respectively, said first and second bend lines (55) being aligned with at least a portion of said first and second outer edges (9), respectively, of said first and second laterally-spaced fastening portions (8) of said interface member (5);

d. fastening said third fastening portion (14) of said retention member (11) to said first fastening portion (8) of said interface member (5) with an integral key tab (17) that extends from said third fastening portion (14) and is received by a key slot (18) in said first fastening portion (8);

e. pivoting said retention member (11) on the interface between said integral key tab (17) and said key slot (18) to bring said fourth fastening portion (14) of said retention member (11) together with said second fastening portion (8) of said interface member (5); and f. fastening said fourth fastening portion (14) of said retention member (11) to said second fastening portion (8) of said interface member (5) with a separate fastener (28); wherein g. said first and second tabs (16) extend toward said fence frame member (3), h. at least one fastener (28) of said second plurality of fasteners (28) has a pointed tip (48) oriented toward said fence frame member (3), i. said first and second tabs are substantially as wide as said third and fourth laterally-spaced fastening portions (14) and substantially wider than said pointed tip (48) of said at least one fastener (28), j. and one of said first and second tabs (16) and one side of said central portion (6) bracket said pointed tip (48) of said at least one fastener (28) and said fence frame member (3) is disposed opposite said pointed tip (48) of said fastener (28), all being in close enough proximity to shield said pointed tip (48) of said at least one fastener (28).

21. The method of forming a fence-frame-to-post connection (1) of claim 20, wherein:

a. said first and second interface portions (10) of said interface member (5) interface with said fence frame member (3); and b. said middle portion (12) of said retention member (11) registers with said post member (2).

22. A fence-frame-to-post connection (1) comprising:

a. an elongated fence post member (2);

b. a fence frame member (3) disposed closely adjacent to said elongated post member (2);

c. a fence-frame-to-post connector (4) for attaching said frame member (3) and said post member (2), said connector (4) including:

i. an interface member (5) including:

1. a central portion (6), said central portion (6) partially encompassing said post member (2), said central portion (6) having first and second ends (7) laterally spaced from one another;
2. first and second laterally-spaced fastening portions (8) attached to said first and second ends (7) of said central portion (6), said first and second fastening portions (8) being substantially planar and having first and second outer edges (9), respectively, said first and second outer edges (9) being laterally spaced away from said first and second ends (7), respectively, of said central portion (6); and
3. first and second interface portions (10) adjoining and being fastened to said fence frame member (3);

ii. a retention member (11) including:

1. a middle portion (12), said middle portion (12) partially encompassing said post member (2), said middle portion (12) having third and fourth ends (13) laterally spaced from one another; and
2. third and fourth laterally-spaced fastening portions (14) attached to said third and fourth ends (13) of said middle portion (12), said third and fourth fastening portions (14) being substantially planar and having fifth and sixth ends (15) laterally spaced away from said third and fourth ends (13) of said middle portion (12), said third and fourth fastening portions (14) being fastened to said first and second fastening portions (8) of said interface member (5); wherein:

d. said interface member (5) is joined to said retention member (11) by a hinged connection (29), e. said third fastening portion (14) of said retention member (11) is fastened to said first fastening portion (8) of said interface member (5) with an integral key tab (17) that is cut out of the material of the third fastening portion (14) distal of said fifth end (15) and has a constricted portion (43) and ends in an expanded portion (44), said key tab (17) extending from said third fastening portion (14) and being received by a key slot (18) having an enlarged portion (46) and a restricted portion (45) and wherein said constricted portion (43) of said key tab (17) is received by a restricted portion (45) in said first fastening portion (8) and said expanded portion (44) is disposed on said side of said first fastening portion (8) closer to said fence frame member (3), said integral key tab (17) and said key slot forming said hinged connection (29); and f. said fourth fastening portion (14) of said retention member (11) is fastened to said second fastening portion (8) of said interface member (5) with a separate fastener (28).

23. The fence-frame-to-post connection (1) of claim 22, wherein:

a. first and second tabs (16) are angularly attached to said fifth and sixth ends (15) of said third and fourth fastening portions (14) along first and second bend lines (55), respectively, said first and second bend lines (55) being aligned with at least a portion of said first and second outer edges (9), respectively, of said first and second laterally-spaced fastening portions (8) of said interface member (5).

* * * * *